US005273344A

United States Patent [19]

Volkwein et al.

[11] Patent Number: 5,273,344

[45] Date of Patent: Dec. 28, 1993

[54] PROCESS FOR INERTING A COAL MINING SITE

[76] Inventors: Jon C. Volkwein, R.D. #2, Cannonsburg, Pa. 15317; Michael T. McCullough, R.D. #1, Rural Valley, Pa. 16249

[21] Appl. No.: 993,685

[22] Filed: Dec. 21, 1992

[51] Int. Cl.[5] ..... E21F 5/00

[52] U.S. Cl. ..... 299/12; 175/71

[58] Field of Search ..... 299/11, 12, 68; 175/65, 175/71

[56] References Cited

U.S. PATENT DOCUMENTS 4,842,444 6/1989 Cowan .

FOREIGN PATENT DOCUMENTS 635249 11/1978 U.S.S.R. ..... 299/12

OTHER PUBLICATIONS

*Petroleum Engineer*, "Drilling with Engine Exhaust Gases", Charles B. Erbe, pp. B46-B52, Aug. 1955.

*Petroleum Engineer*, "Drilling with Air", Earl R. Bruno, pp. B21-B24, Jan. 1956.

Feasibility Study of Mining Coal in an Oxygen Free Atmosphere, by Island Creek Coal Company, Aug. 1970.

*Primary Examiner*—David J. Bagnell

*Attorney, Agent, or Firm*—Clifford A. Poff

[57] ABSTRACT

A process of inerting the coal mine site formed by a coal cutting auger or continuous miner at a coal face to supress methane/coal dust explosion includes introducing an inert gas such as waste gases of combustion or nitrogen, for example, to a site downstream of the coal face in a sufficiently great volume to always replace the volume of coal carried from the coal face by a conveyor. The flow of coal by the conveyor is used to form the impetus to move inert gas from the introduction site to the coal face. The volume of inert gas at the introduction site is maintained sufficient to inhibit ingress of oxygen bearing atmospheric air to the coal face. A leaky seal may be used at the entrance to the coal face at the mining site. The inert gas may be introduced by a conduit arranged part way in the coal seam to form a separate duct extending in the coal seam to the mined cavity or by a duct formed as in integral part of the coal conveyor.

20 Claims, 6 Drawing Sheets

PROCESS FOR INERTING A COAL MINING SITE

BACKGROUND OF THE INVENTION

1. Field of the Invention

The present invention relates generally to a process and apparatus for providing an inert atmosphere at a coal mining face during a mining operation to prevent the formation of an explosive mixture. More particularly, the present invention provides such an inert atmosphere by causing the volume of coal carried away from a mine face to be replaced by an inert gas by utilizing the coal flow as the impetus for the flow of inert gas to the mine face from the introduction site.

2. Description of the Prior Art

While not so limited, the present invention is particularly useful incident to the extraction of coal by highwall mining methods. Two such highwall coal mining methods known in the art are: first method using an auger type cutting and an auger conveying system and; more recently a second method using a continuous mining type cutting machine combined with a belt type conveying system. These highwall mining methods enable the recovered coal from a reserve when removal of the overburden by surface mining equipment becomes uneconomical. When augers are used, the auger enters the coal seam while rotating about an axis that is generally horizontal by a drive from a mine bench at the highwall. Coal is won by drilling a series of generally parallel holes that penetrate the mine seam up to distances of 400 or more feet. The auger device for cutting the coal seam are well known in the art. It is to be noted that augers and other coal cutting devices can be used to win coal wherein the rotational axis of the cutting device, when in the form of an auger, is orientated vertically or at an angle ranging between the vertical and horizontal. At very shallow depths little methane has been encountered with auger mining particularly when the penetration depth by the auger is of a shallow depth because methane is usually depleted by natural dissipation to the atmosphere when coal is near the ground surface. Pockets of methane may be encountered at depths as small as 35 feet. Conventional auger mining involves a penetration depth usually between 100 and 200 feet. However, penetration depths of 1000 and even as high as 1200 feet in to a highwall have been accomplished by the use of a continuous haulage system made up of a tandem arrangement of cascading conveyors that can convey the coal in an uninterrupted fashion from the coal face where coal is released by a continuous mining all per se well known in the art.

A severe problem of uncontrolled ignition, i.e., explosion, occurs without advance warning when pockets of methane are encountered during the coal releasing operation. The occurrence of quantities methane in excess of 2% of the volume in the interior of a highwall auger hole is unacceptable when there concurrently exists sufficient oxygen that will allow combustion. Moreover, an explosive environment may be created by a fuel source other than or in combination with methane such as coal dust. As is known in the art, coal dust attains an explosive condition when the dust mixture has 80 grams per cubic meter in atmospheric air under standard condition. As methane is added to the air - dust mixture, a liner relationship exists between these two components under explosive conditions. For example at 2.5% methane (i.e. 50% of the explosive limits methane is under) 40 grams of dust per cubic meter renders the mixture explosive.

Even when the necessary components and conditions exist for combustion to occur at the mine face, the difficulties to disarm the components and conditions by ventilating are compounded by a necessity of assuring the reliability of disarmament. When some ventilation to the coal cutter site at the front of the mining head is achieved, the ventilation medium may combine with methane to convert a methane rich but nonexplosive mixture to an explosive mixture. Also, ventilation is ineffective to prevent a dust explosion in such a mining configuration. An ignition source is often present in an auger type mining machine because the use of water or air to cool coal cutting bits is not practicable or reliable as a measure to always prevent the development of an ignition source.

The process of using inert gas to mine coal has been considered, for example, in *Feasibility Study on Mining Coal in an Oxygen Free Atmosphere,* Federal Water Quality Administration, Department of the Interior NTIS PB-197446, August 1970, 162 p. This report essentially dealt with air lock technology to place an entire conventional underground mine in an inert gas atmosphere and place the workers in "space suits". Use of inert gas to prevent explosions is per se, well known. The present invention eliminates the need for air lock technology while providing a method of supplying inert gas to an area which is otherwise inaccessible. Moreover, implementation of the inert gas to suppress combustion in underground mining is complicated and complex because of, inter ali, the underground environment. However, the underling discovering of the present invention is that the immediate vicinity of a coal face from which coal is being released can be inerted irrespective of whether the coal face is accessed from the surface or from an underground mine to prevent explosions at the mining site. Moreover, it has been discovered that the placement of inert gas can be effectively performed to not only assure movement of the inert gas to the cutter head but also in a manner that will allow monitoring of the hole atmosphere.

SUMMARY OF THE PRESENT INVENTION

It is an object of the present invention to use inert gas to eliminate explosions in highwall mining.

It is a further object of the present invention to prevent methane gas or coal dust explosions by supplying low oxygen content gas to cutting picks of a mining machine. According to the present invention there is provided a process of inerting the coal mining site formed by a coal cutter at a coal face and a conveyor to carry coal won by the coal cutter away from the receding mine face to a transfer area serviced by the conveyor downstream of the coal face, the process comprises the step of introducing an inert gas to site downstream of the coal face in a sufficiently great volume to always replace the volume of coal carried from the coal face by the conveyor, using the flow of coal by the conveyor for the impetus to move inert gas from the introduction site to the coal face, and maintaining a volume of the inert gas at the introduction site sufficient to inhibit ingress of oxygen bearing atmospheric air to the coal face.

Waste gases of combustion from an internal combustion engine, particularly, such an engine using gasoline as a fuel source, are suitable source generator to form the inert gas supply. Such an inert gas supply is particularly advantageous because a gasoline fueled and internal combustion engine operates with stoichiometric quantities of oxygen. Low oxygen content is further assured to a large extent by the use of a catalytic converter in the waste gas stream. Other forms of inert gas supplies may be used including quantities of the waste gas from a diesel engine when operated under a sufficient load so as to avoid excessive amounts of oxygen in the waste gases. The waste gases are preferably introduced into site along a coal conveying auger that is downstream from the mining of the coal by cutting picks. The picks may be part of an auger coal cutter or of a continuous miner. The atmosphere formed by the inert gas at the introduction site is delivered in quantities to prevent the ingress of oxygen by the creation of a positive pressure at the introductory site.

BRIEF DESCRIPTION OF THE DRAWINGS

These features and advantages of the present invention as well as others will be more fully understood when the following description is read in light of the accompanying drawings in which.

DETAILED DESCRIPTION OF THE PREFERRED EMBODIMENT(S)

Figure 1:
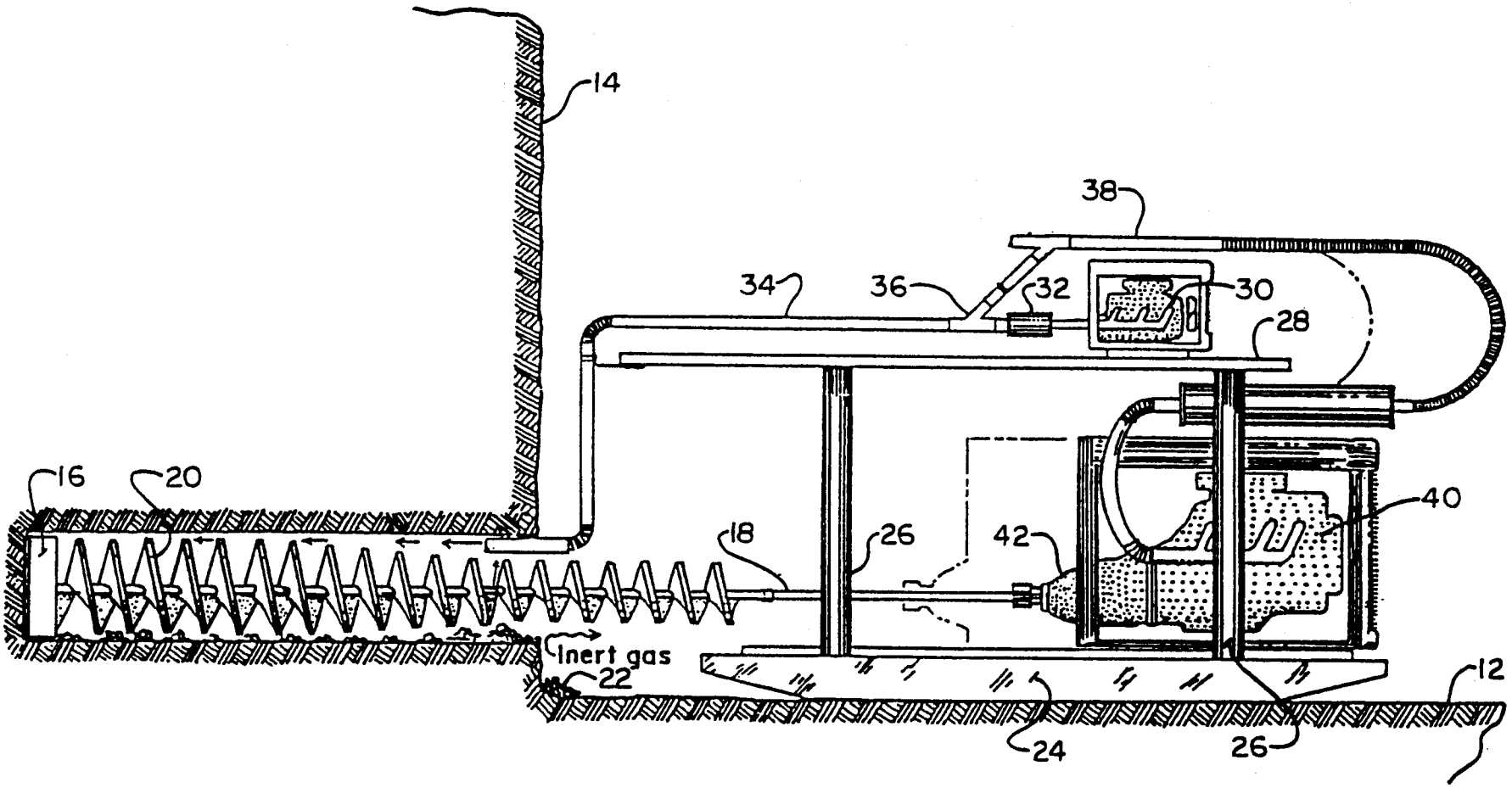
FIG. 1 is an elevational view in section of a first embodiment auger mining arrangement in a highwall mine using the present invention.

In FIG. 1 there is schematically illustrated a preferred embodiment of the present invention for inerting a coal mining site. The preferred mine site is a highwall mine that includes a surface mine bench 12 comprising a horizontal ground surface extending to a highwall mine face 14. The mine face is coal bearing and to recover the coal there is provided a suitable coal mining facility which may be of any of diverse configurations but in the preferred embodiment of FIG. 1 comprises a coal mining auger cutter 16 driven by a drive shaft 18 having thereon a helical arrangement of flight attachments 20 that transport, in a manner per se well known in the art, coal released from the mine face in a direction toward the mine bench for recovering at a collection site 22. The collection site is generally comprised of a coal pile on the mine bench between the highwall mine face 14 and parallel spaced apart skid bars 24 forming part of a super structure for supporting a drive system for the mining machine. Support posts 26 are arranged in an upstanding manner on the skid bars and carry a platform 28 at an elevation above the bench 12. On the platform 28 there is mounted an internal combustion engine 30 together with the necessary controls and fuel supply for operation of the combustion engine. The coal mining auger cutter 16 as well as the helical arrangement of flight attachments 20 can be replaced with other well known forms of coal mining cutters and conveying systems such as, for example, a continuous miner and belt conveyors.

A suitable internal combustion gas engine can be suitably selected as a General Motors 305 cubic inch engine which operates with fuel to oxygen stoichiometry so that the exhaust gases, particularly after process in the catalytic converter 32 minimizes the oxygen content of the waste products of combustion from the engine. The products of combustion discharge from the catalytic converter 32 are conveyed by a conduit 34 which includes a Y pipe section 36 that is joined by a conduit line 38 to the exhaust manifold of a diesel engine 40 and comprises the prime mover for driving the coal mining auger and the coal conveying auger 16 and 20, respectively. For this purpose the drive output shaft of the diesel engine is connected by a drive transmission 42 that is in turn connected to the shaft 18. Conduit 34 is supported by stabilizers that in turn allow the duct to descend along a part of the wall face 14 where there is a flexible elbow section that directs the terminal end portion of the pipe into the hole in the highwall produced by the mining head. An important discovery of the present invention resides in the utilization of the movement of a volume of coal from the mine cutter head as the impetus for drawing inert gas injected at the end of the duct 34 to completely replace the coal volume won from the coal face through operation of the coal mining cutter with inert gas. In this way, any release of methane from newly exposed coal surfaces is immediately brought into intimate contact with an atmosphere that is wholly controlled and maintained inert.

It has been found that the exhaust gases from the gasoline type internal combustion engine when supplemented, if necessary, by additional quantity of exhaust gases from the diesel engine 40 can be supplied in quantities that are sufficient to maintain a supply of inert gas along a given length of the auger to act in response to the impetus caused by the outflow of won coal. However, other sources of inert gas having an effecting excess nitrogen concentration of 34 volume pct or greater may be used to prevent methane from igniting. Sources of inert gas for this purpose includes combustion furnace, liquid nitrogen, inert gas generators of the type conventionally used for metal annealing or hydrocarbon shipping and transfer and jet turbine engine. In this event a selected inert gas source is too high in oxygen content, a fueled afterburner can be used in the gas stream to reduce the oxygen content. Operation and purchase costs can be factors affecting the selection of the inert gas source.

Figure 2:
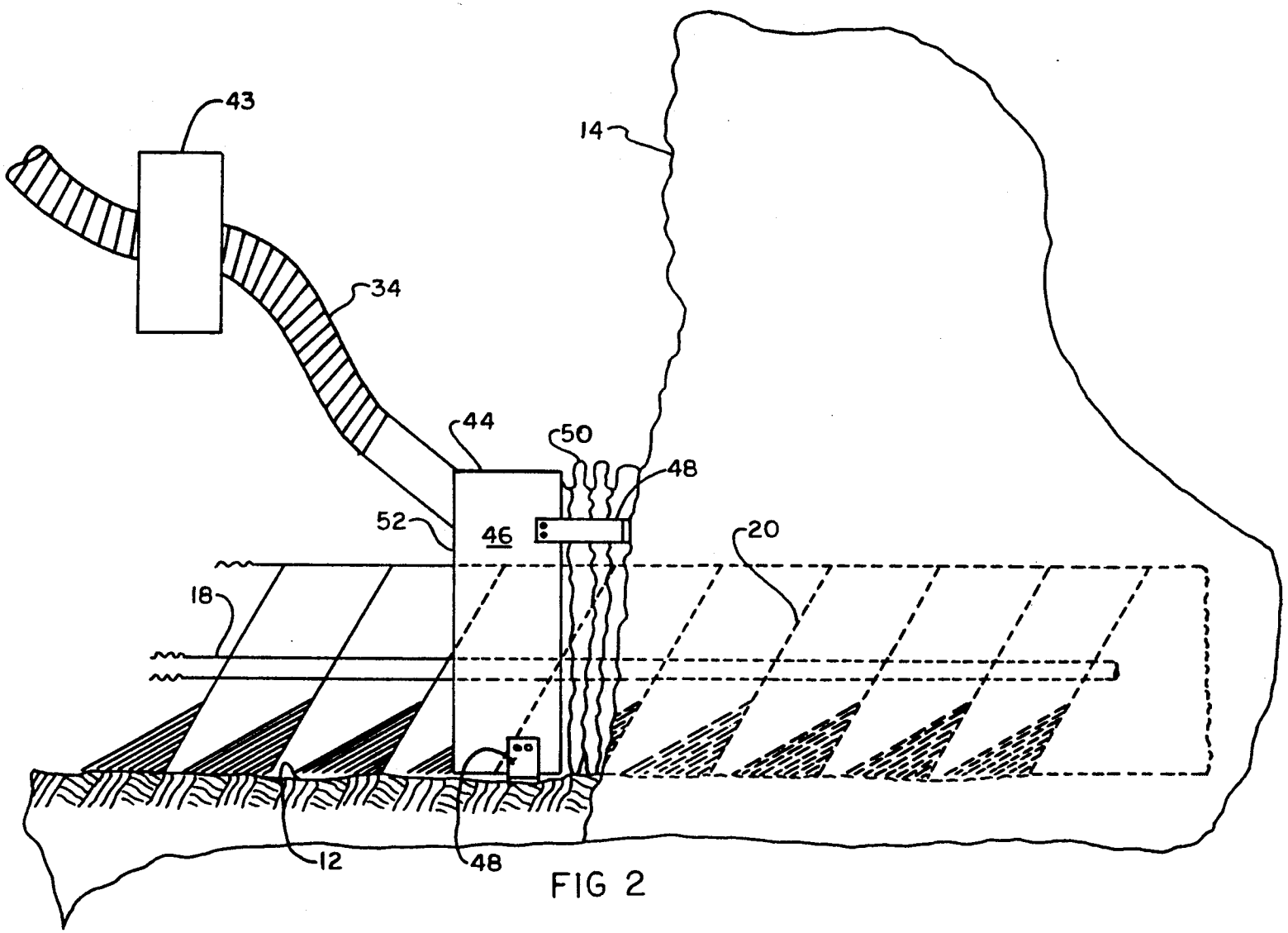
FIG. 2 is an enlarged elevational view in section showing a second embodiment of the present invention using a shroud enclosure for an auger conveyor at the entrance of a highwall mine face.
Figure 3:
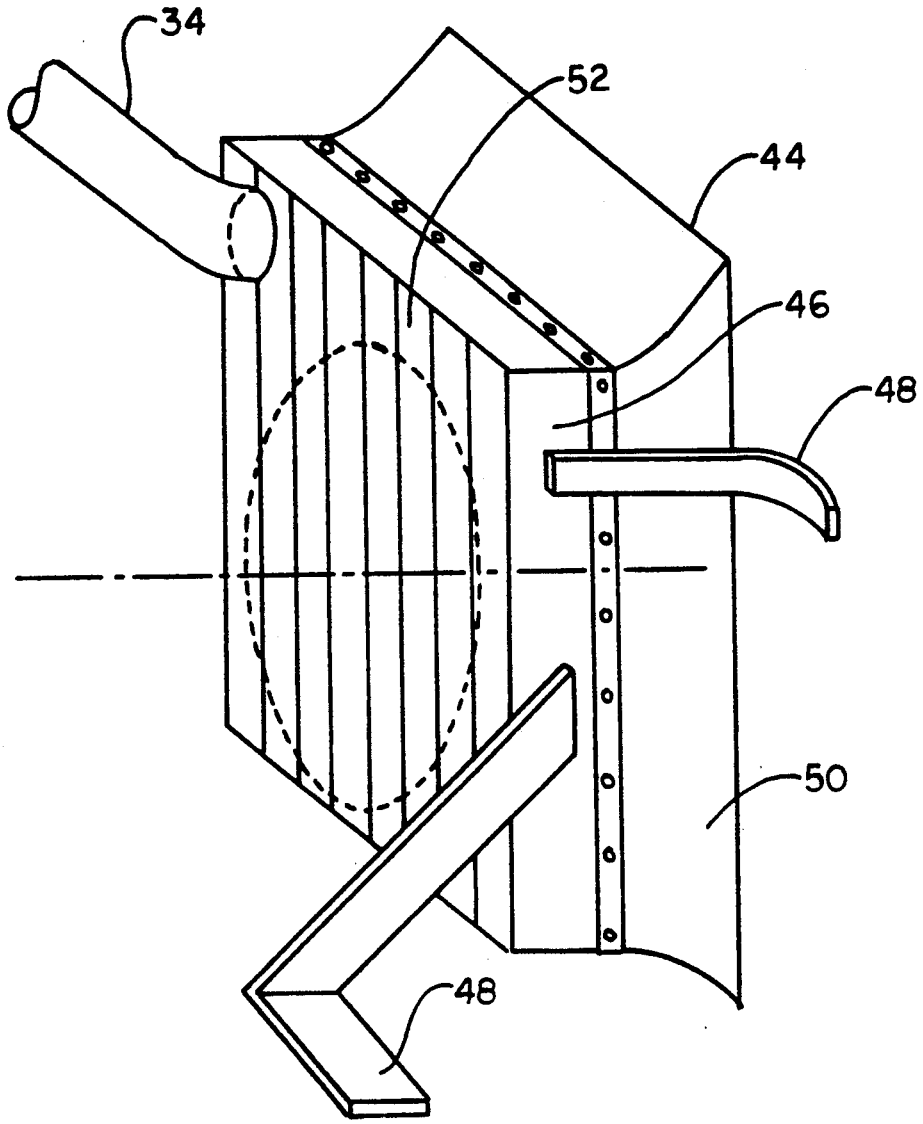
FIG. 3 is an isometric view of the shroud enclosure shown in FIG. 2.

In FIGS. 2 and 3 illustrate a second embodiment of the present invention that essentially includes the addition of a fluid afterburner 43 and a shroud at the coal face in a highwall mine. As shown in FIG. 2 and as described earlier herein in regard to FIG. 1, the drive shaft 18 is illustrated with the flight attachments 20 in a helical configuration extend from the outside atmosphere into the auger hole by passing through a shroud assembly 44. Assembly 44 is made up of an outer rigid frame 46 that is secured to the mine face by strap members 48 and to the ground surface 12 to firmly hold the outer rigid frame 46 at a closely spaced apart relation from the mine face. Between the rigid frame and the mine face there is a flexible skirt 50 that can be made of cloth, rubber material or the like, preferably, for example, of the same material conveyor belting material is made from. The purpose of the skirt is to form a chamber which holds the inert gas in the auger hole. Slight pressurization of the chamber thus formed with inert gas prevents the ingress of oxygen contained in atmospheric air to the auger hole. At the side of the rigid frame 46 which is opposite the flexible skirt there is provided a multiplicity of vertically extending relatively narrow seal strips 52 that overlap along their longitudinal axis, as best shown in FIG. 3, the seal strips are preferably made of conveyor belt material so that their mass or unit of length seals the entrance way to the rigid frame to prevent an ingress to any substantial extent of oxygen bearing atmospheric air. At a corner site which is remote to the entrance site of the screw conveyor through the flexible steel strips there is provided a collar which is supported by the rigid frame through the use of brackets to provide an entrance site for a heat resistant tubing extending from which is the preferred form of conduit line 34 extending from the Y pipe section for conducting the inert gases comprised of waste products of combustion through the frame structure and a short distance along the auger hole where the conduit terminates.

The source of the inert gas as explained hereinbefore, may be supplemented by the exhaust from a diesel engine that forms the power unit for driving the mining machine. The exhaust gases from such a diesel power plant range in oxygen concentration from 8% to 17% at 100% to 0% load, respectively. In the event the oxygen concentration is too high for a particular operation condition, a fueled afterburner is connected to operate on the exhaust gas stream so as to reduce the oxygen content to acceptable levels for use to inert the mine site. At 40% load, the diesel engine exhaust has a lowered oxygen content but an elevated carbon dioxide content which when mixed with methane, the methane exhaust mixture is non-explosive except where the mixture is further infiltrated with oxygen bearing air. The present invention prevents explosions at mine faces where there operates a mining auger or other mining machine by the progression of the inert gas having the necessary constitutes necessary to prevent an explosion. Unless prevented by the present invention, oxygen will normally migrate to the mine face from an entry site at the collar and when the oxygen reaches the mine face, turbulent mixing occurs by the coal cutter, e.g., auger, with any methane at the mine face. In the event the inert gas from the gasoline engine which contains an over abundance of inert gas concentration is insufficient to inert the mining site the volume from the diesel engine can be used as a supplemental inert gas supply because of an overabundance even though the diesel exhaust per se contains an insufficient inert gas concentration. By combining the full volume of the gasoline engine and a portion of the diesel engine volume the yield is the correct gas volume with a correct inert gas concentration.

As a supplemental inert gas source, the combustion products comprising the exhaust volume of a diesel engine is about 225 cfm. When added to the combustion products of a 305 cfm gasoline powered engine, the combined volume of inert gas greatly exceeds by a factor of at least 5 the volume of coal extracted using the engines as the prime movers for the mining operation. On the other hand, diesel engines used to power auger mining machines having far greater horse power output and therefore a far greater exhaust volume is available as an inert gas source and will greatly exceed the coal volume extraction rate. Thus, since it is desired to replace the extracted coal volume with inert gas, the inert gas supply greatly exceeds, with a more than adequate safety factor, the requirements for inerting the auger mining site. The process of the present invention is effective to provide a inert atmosphere using exhaust gases from internal combustion engines which is enhanced by placing a shroud 56 at the collar of the entry in a manner that a leaky seal is formed where the mining equipment e.g., auger conveyor or belt conveyor penetrates the shroud to extend to the mine face. The exhaust gases are preferably introduced through the shroud in sufficient quantities to pressurize the auger hole while enclosed by the leaky seal of the shroud, thus preventing the entrance of oxygen bearing air along the track which coal is conveyed as well as at the mine face.

In highwall mining operations, for example, access to the coal mining site for the direct discharge of an inert gas and/or a fluid medium to suppress explosions is impeded by the design and the construction of the coal mining operation. It is necessary to carry out the inerting process at the mine face as well as other sites downstream thereof until such point where the solid coal with any residual methane can be safely exposed to the atmosphere without an explosion. Monitoring of the atmosphere entrained with the out-flowing coal as a control measure to prevent explosion must be coupled with an assurance that inert atmosphere sufficient to prevent explosion exists not only at the coal face but also along the path of travel for the won coal.

The available gas volume may be determined by the hot exhaust gas flow from the engines or the volume of gas leaving the hole. Hot engine exhaust gas condenses and contracts as it cools inside of the auger hole, and consequently a large correction factor must be used to determine the true exhaust volume if hot gas flow is measured. A correction factor may be derived empirically by testing. The correction factor multiplied times the hot exhaust gas flow measurement, yields the available inert gas volume for the combined engine flow.

In a test it was found that the minimum cooled gas volume found during testing was 50 cfm. The maximum rate of coal removal was determined to be 42 cfm. This calculates to a 16 pct excess volume of inert gas for the worst case conditions, that is minimum volume and maximum coal removal. For average conditions, 56 cfm of exhaust was present and coal removal was 35 cfm, or 37 pct excess inert gas volume.

Gas concentrations introduced at the collar of the hole were found to move to the head of the auger mining machine into the hole, and remained in the hole until after removal of the auger head.

Figure 4:
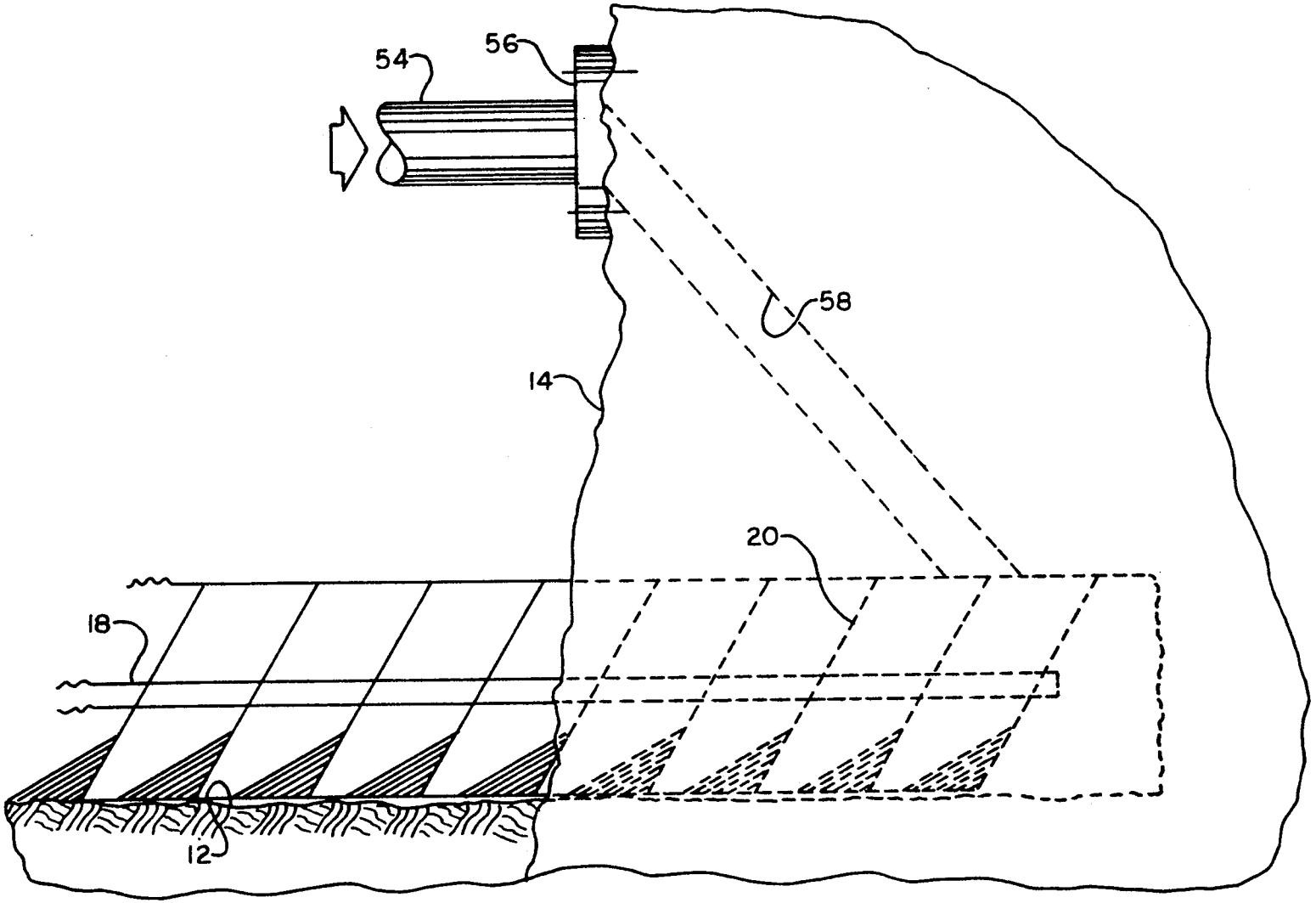
FIG. 4 is a view similar to FIG. 2 and illustrating the third embodiment of an inert gas introduction system according to the present invention.

In FIG. 4 there is illustrated an alternative procedure for introducing the inert gas to the mine cavity wherein the conveying auger operates for movement to the mine face. Inert gas is introduced through by a duct 54 affixed to a mine face by a collar 56 to communicate with an angled bored hole 58 extending to the auger operation site. This arrangement has the advantage of situating the inert gas supplied ducts remote to the coal auger. Also, a shroud assembly is unnecessary in this embodiment of the present invention because a leaky seal is also unnecessary.

Figure 5:
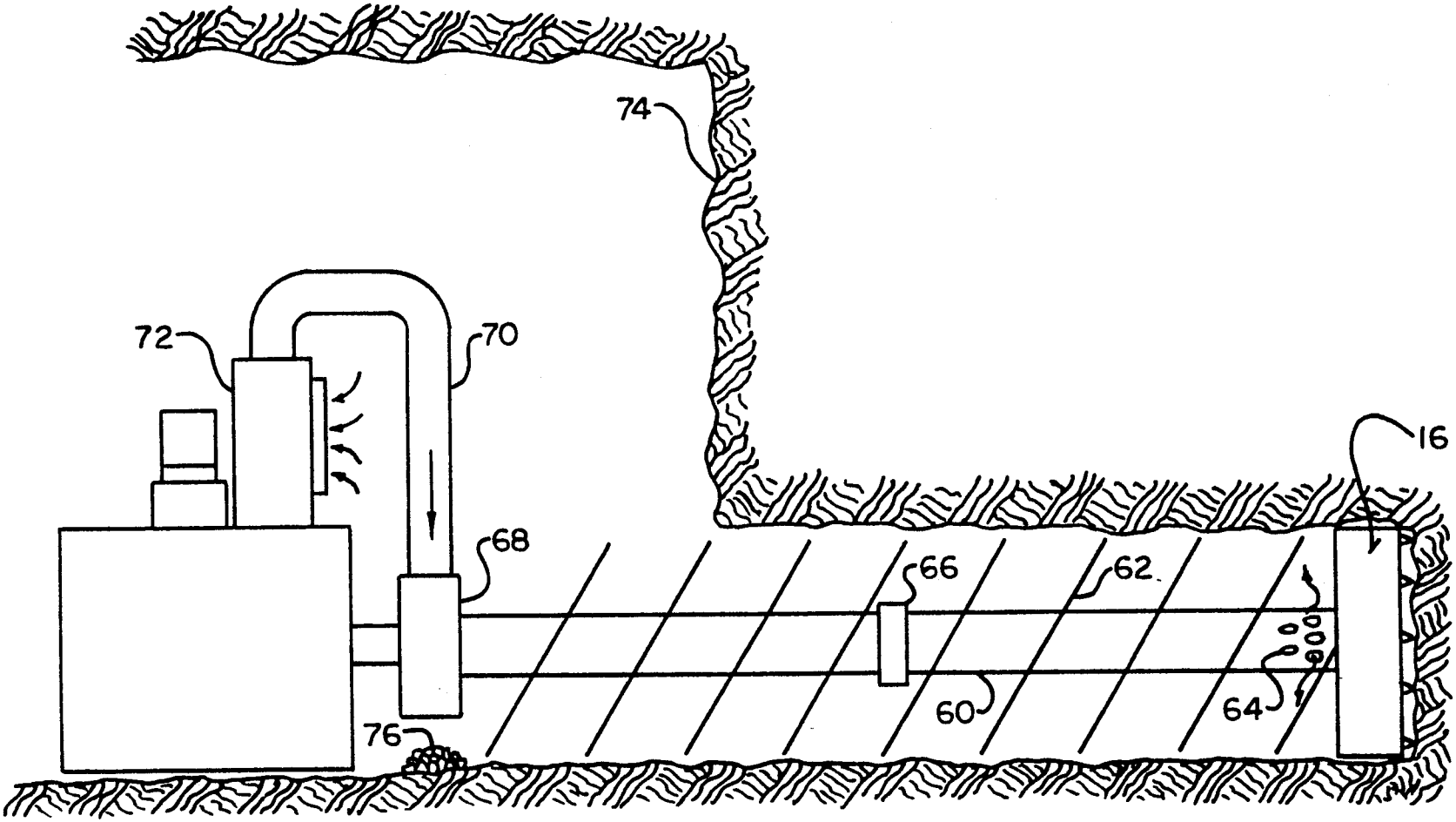
FIG. 5 is an elevational view in section illustrating a fourth embodiment.

It is within the scope of the present invention to provide that the conveying system for coal won by the mining operation may be adapted for transmission of inert gas to a vicinity adjacent to the coal mining machine. When a belt type coal conveyor is used, the super structure to support the conveyor belt can be modified to provide a suitable duct for the inert gas. When the coal is conveyed by an auger type conveyor, the drive-support shaft, as shown in FIG. 5, can be constructed from a suitable length pipe 60 or other tubular shaped structure. Flight attachments 62 are secured by weld to the outer periphery pipe 60. The end portion of tube 60 most adjacent the coal mining auger cutter 16 is formed with an array of openings 64 which are of a size and number sufficient to pass a required volume of inert gas into the mining cavity closely spaced downstream of the mining head 16. The tube 60 is a structural part of the coal conveying auger and is joined by couplings 66 to other similarly constructed auger sections to allow mining to proceed to a desired penetration depth in the coal seam. Thus it can be seen the inert gas flows in a direction parallel to the direction of coal flow but counter concurrent. At a desired site along the length of the coal auger at the mining bench 12 there is provided a means such as a rotary coupling 68 mounted on a pipe 60 to allow inert gas to be introduced from conduit 70 for transmission along pipe 60. Conduit 70 delivers a discharge flow of inert gas from an inert gas generator 72 of a type per se well known in the art. In the embodiment of FIG. 5, auger 16 and flight attachment operate in a coal face 74 of an underground mine to release coal and discharge the coal to a coal pile 76 which is transported by suitable conveyance structure, per se well known in the art, above ground.

It is to be understood in each embodiment of the present invention the coal mining operation by the coal miner whether of an auger type, continuous miner or other form proceeds to completion in a given entrance site in a highwall without sensation of a mining operation. In this way, once a mining operation begins by the formation of a hole or cavity in the mine face, the inerting process continues so long as the mining operation proceeds in that cavity.

Figure 6:
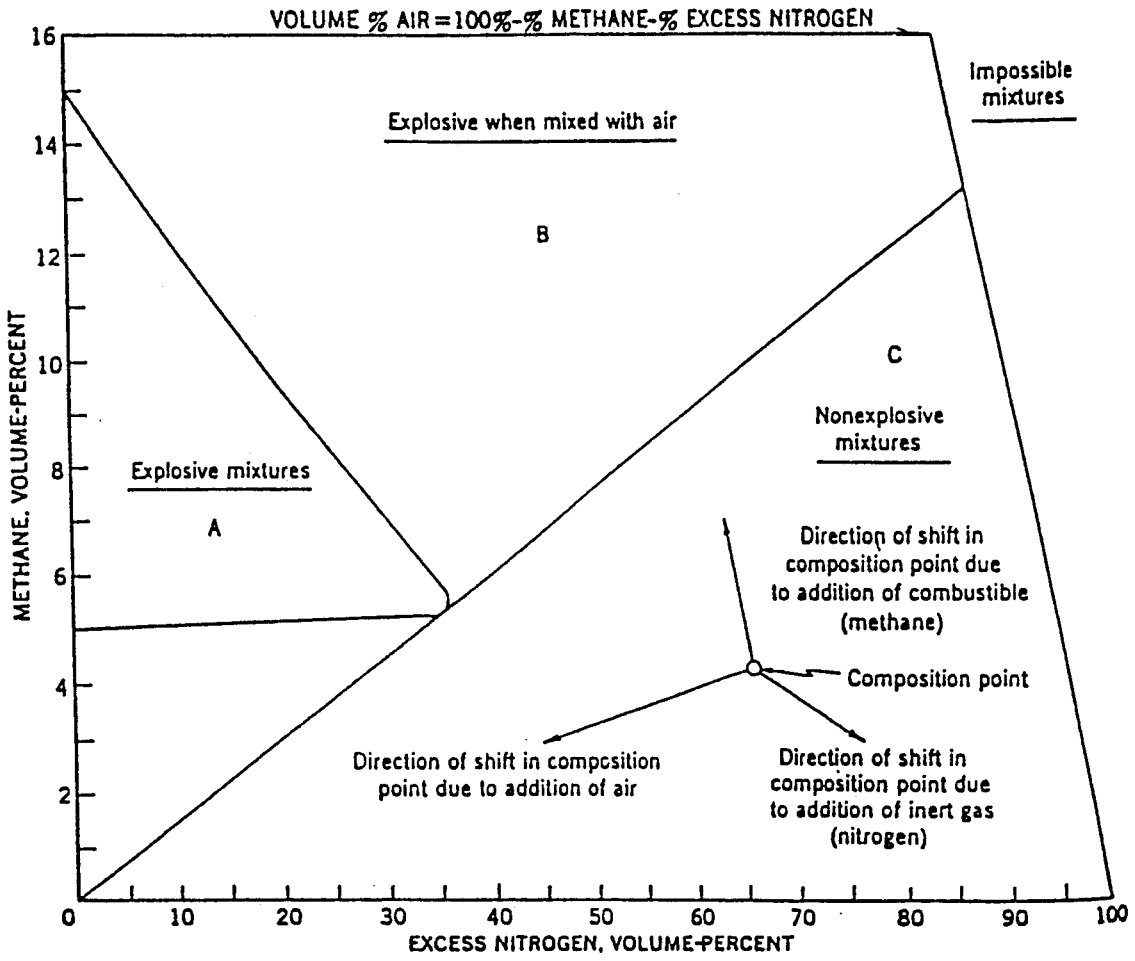
FIG. 6 is an exposibility diagram for volume percent of methane and inert gas.

FIG. 6 shows an exposibility diagram as found in information circular 1901 dated 1959 by United States Department of Interior entitled *Determining the Explosibility of Mine atmospheres* by M. G. Zabetakis, R. W. Stahl, and H. A. Watson. The explosiblity diagram is for methane-nitrogen-air mixtures at 80° F. and atmospheric pressure. This diagram is used to show whether a particular mixture of methane, nitrogen and air fall within area A "Explosive mixtures", will become "Explosive when mixed with air" so as to fall in area B, or become "nonexplosive" so as to fall in area C. An "Explosive" mixture may be ignited "as is"; therefore, it could cause a gas explosion. A mixture that will become "Explosive when mixed with air" contains so much combustible gas and perhaps inert gas, such as carbon dioxide or nitrogen, that it is not explosive; however, it would form explosive mixtures upon the addition of air. A "nonexplosive" mixture contains either so much inert gas or so little combustible gas that it cannot be ignited "as is"; furthermore, it will not form explosive mixtures when air is added. This figure demonstrates that as higher levels of methane are encountered, the effective inert concentration requirements are reduced to remain below the explosive limit. The rendering of the mining cavity nonexplosive can be achieved by the use of a gaseous medium such as methane which is introduced in quantities sufficient to reduce the oxygen content in the mining cavity from the area B shown in FIG. 6 and labeled "explosive when mixed with air" to the area C labeled "nonexplosive mixtures".

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

We claim:

1. A process of inerting the coal mining site formed by a coal cutter at a coal face and a conveyor to carry coal won by the coal cutter away from the receding mine face to a transfer area serviced by the conveyor downstream of the coal face, said process comprises the step of:

introducing an inert gas to site downstream of said coal face in a sufficiently great volume to always replace the volume of coal carried from the coal face by said conveyor;

using the flow of coal by the conveyor for the impetus to move inert gas from the introduction site to the coal face; and maintaining a volume of said inert gas at the introduction site sufficient to inhibit ingress of oxygen bearing atmospheric air to the coal face.

2. The process according to claim 1 wherein said step of introducing an inert gas includes conducting gas from conducting waste products of combustion from an internal combustion engine.

3. The process according to claim 2 wherein said internal combustion engine comprises a gasoline powered engine having a catalytic converter in the flow path for waste product of combustion.

4. The process according to claim 1 including the further step of using an afterburner for generating said inert gas.

5. The process according to claim 1 including the further step of enclosing the entrance to the coal mining site by said conveyor to impede infiltration of oxygen bearing gases to the mine face.

6. The process according to claim 5 wherein a shroud is placed about the entrance to the mine site.

7. The process according to claim 1 wherein said inert gas is introduced by a conduit extending along at least a part of the track of the conveyor.

8. The process according to claim 1 wherein said inert gas is introduced through a duct work formed at the coal mining site from the atmosphere in a direction to intersect with the path of travel by said conveyor.

9. The process according to claim 1 wherein said coal mining site comprises a highwall mine.

10. The process according to claim 1 wherein said conveyor comprises an auger conveyor having flight attachments arranged on a drive shaft in a helical fashion.

11. The process according to claim 1 wherein said coal cutter is a continuous mining machine.

12. The process according to claim 1 wherein the inert gas has an effective excess nitrogen content of 34 vol. % or greater.

13. The process according to claim 1 wherein the volume of inert gas introduced downstream of the coal face is sufficient to increase the gas pressure above atmospheric pressure.

14. The process according to claim 1 wherein the source of inert gas essentially comprises waste products of combustion passed through a catalytic converter from a gasoline powered internal combustion engine and at least a portion of waste product of combustion from a diesel engine.

15. The process according to claim 14 wherein said diesel engine is operated under a load of at least 40% to reduce the oxygen content of combustion gases.

16. The process according to claim 1 wherein the source of inert gas includes liquid nitrogen.

17. The process according to claim 1 wherein the source of inert gas includes an inert gas generator.

18. The process according to claim 1 wherein the source of inert gas includes a jet turbine engine.

19. The process according to claim 1 wherein said step of introducing an inert gas includes conducting such gas along a duct extending in a direction parallel with the direction in which coal is carried by said conveyor.

20. The process according to claim 1 wherein said coal mining site comprises an underground mine having a coal face.

* * * * *

US005273344A

REEXAMINATION CERTIFICATE (2592nd)

United States Patent [19]

[11] B1 5,273,344

Volkwein et al.

[45] Certificate Issued May 30, 1995

[54] PROCESS FOR INERTING A COAL MINING SITE

[76] Inventors: Jon C. Volkwein, R.D. #2, Cannonsburg, Pa. 15317; Michael T. McCullough, R.D. #1, Rural Valley, Pa. 16249

Reexamination Request:
No. 90/003,590, Oct. 5, 1994

Reexamination Certificate for:

| | |
|---|---|
| Patent No.: | **5,273,344** |
| Issued: | **Dec. 28, 1993** |
| Appl. No.: | **993,685** |
| Filed: | **Dec. 21, 1992** |

[51] Int. Cl.[6] ..... E21F 5/00
[52] U.S. Cl. ..... 299/12; 175/71
[58] Field of Search ..... 299/11, 12, 68; 175/65, 175/71

[56] References Cited

U.S. PATENT DOCUMENTS 3,922,015 11/1975 Poundstone .
4,072,355 2/1978 Pentith .

*Primary Examiner*—David J. Bagnell

[57] ABSTRACT

A process of inerting the coal mine site formed by a coal cutting auger or continuous miner at a coal face to supress methane/coal dust explosion includes introducing an inert gas such as waste gases of combustion or nitrogen, for example, to a site downstream of the coal face in a sufficiently great volume to always replace the volume of coal carried from the coal face by a conveyor. The flow of coal by the conveyor is used to form the impetus to move inert gas from the introduction site to the coal face. The volume of inert gas at the introduction site is maintained sufficient to inhibit ingress of oxygen bearing atmospheric air to the coal face. A leaky seal may be used at the entrance to the coal face at the mining site. The inert gas may be introduced by a conduit arranged part way in the coal seam to form a separate duct extending in the coal seam to the mined cavity or by a duct formed as in integral part of the coal conveyor.

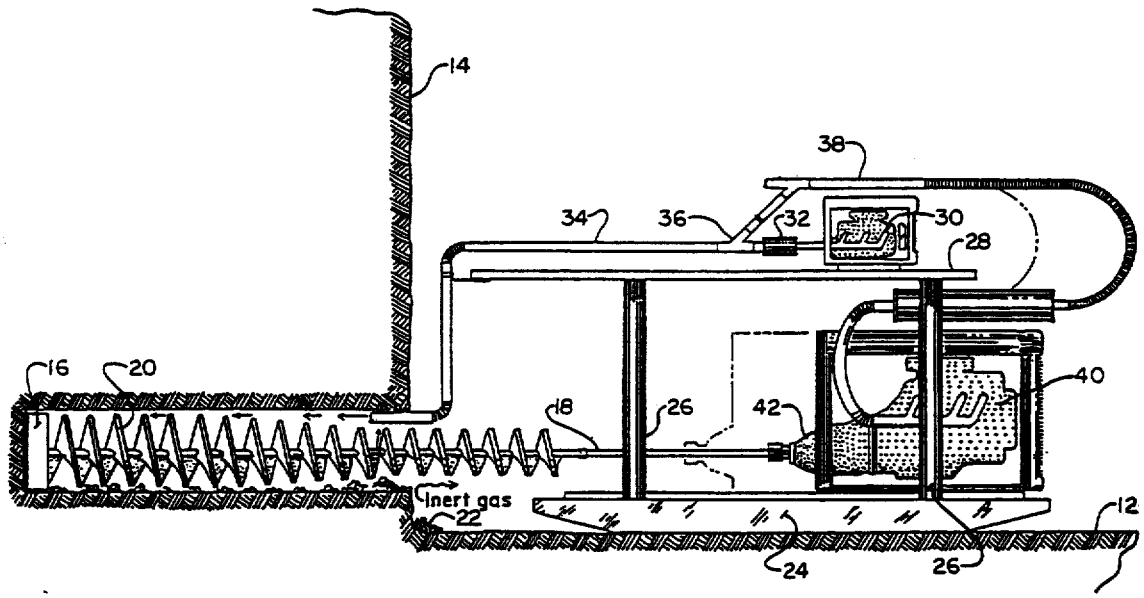

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 8 are determined to be patentable as amended.

Claims 2–7 and 9–20, dependent on an amended claim, are determined to be patentable.

New claims 21 and 22 are added and determined to be patentable.

1. A process of inerting [the] *a solid coal bearing coal face in a* coal mining site formed by a coal cutter at [a] *said solid coal bearing* coal face and a conveyor to carry coal won by the coal cutter away from the receding mine face to a transfer area serviced by the conveyor downstream of the coal face, said process comprises the step of:

introducing an inert gas to site downstream of said *solid coal bearing* coal face in a sufficiently great volume to always replace the volume of coal carried from the coal *said solid coal bearing* face by said conveyor;

*replacing the volume of coal won by the coal cutter with inert gas by* using the flow of coal by the conveyor for the impetus to move inert gas from the introduction site to the *said solid coal bearing* coal face; and maintaining a volume of said inert gas at the introduction site sufficient to inhibit ingress of oxygen bearing atmospheric air to [the] *said solid coal bearing* coal face.

8. [The process according to claim 1] *A process of inerting coal face in a the coal mining site formed by a coal cutter at a coal face and a conveyor to carry coal won by the coal cutter away from the receding mine face to a transfer area serviced by the conveyor downstream of the coal face, said process comprises the step of:*

*introducing an inert gas to site downstream of said coal face in a sufficiently great volume to always replace the volume of coal carried from the coal face by said conveyor;*

*using the flow of coal by the conveyor for the impetus to move inert gas from the introduction site to the coal face; and*

*maintaining a volume of said inert gas at the introduction site sufficient to inhibit ingress of oxygen bearing atmospheric air to the coal face,* wherein said inert gas is introduced through a duct work formed at the coal mining site from the atmosphere in a direction to intersect with the path of travel by said conveyor.

*21. The process according to claim 1 wherein said inert gas is introduced through a duct work formed at the coal mining site from the atmosphere in a direction to intersect with the path of travel by said conveyor.*

*22. The process according to claim 1 wherein said step of replacing includes using a hole which extends from the solid coal bearing coal face to the transfer area for conducting coal won by the coal cutter and moving said inert gas.*

* * * * *